United States Patent [19]

Rivette et al.

[11] 4,316,345

[45] Feb. 23, 1982

[54] TOY DECORATIVE CURTAIN/DOOR

[75] Inventors: Denni F. Rivette, Chicago; Howard J. Morrison, Deerfield; Douglas P. Montague, Chicago, all of Ill.

[73] Assignee: Marvin Glass & Associates, Chicago, Ill.

[21] Appl. No.: 203,398

[22] Filed: Nov. 3, 1980

[51] Int. Cl.[3] ..... A63H 33/00

[52] U.S. Cl. ..... 46/1 R; 46/14

[58] Field of Search ..... 46/1 R, 12, 13, 14; 160/332, 238, 133, 180, 126, 354, DIG. 8

[56] References Cited

U.S. PATENT DOCUMENTS

| | | | |
|---|---|---|---|
| 2,024,090 | 12/1935 | Cadmus | 160/180 |
| 2,148,983 | 2/1939 | Grubb | 160/238 |
| 4,232,725 | 11/1980 | Gidge | 160/332 |

FOREIGN PATENT DOCUMENTS

| | | | |
|---|---|---|---|
| 1283936 | 1/1962 | France | 160/332 |

OTHER PUBLICATIONS

Nieco Strip Doors, Nieco, P.O. Box 4506, Burlington, Cal. 94010, 10/3/77.

*Primary Examiner*—Gene Mancene
*Assistant Examiner*—Mickey Yu
*Attorney, Agent, or Firm*—Mason, Kolehmainen, Rathburn & Wyss

[57] ABSTRACT

A toy decorative curtain/door adapted for temporary installation between vertical jambs of an entrance opening for use in play by young children and the like includes a sheet of thin flexible curtain material mounted on an elongated roller adapted to extend between said opposite jamb surface. At least one end portion of the roller includes means for biasing the roller in a longitudinal direction toward the opposite end for supporting a roller between the jamb surfaces at a selected elevation. The flexible sheet material has an upper edge secured to the roller and a pair of longitudinal downwardly extending opposite edges adjacent the jamb surfaces and a free bottom edge to form a closing curtain for the entrance opening. At least one face of the sheet material has a decorative image thereon preferably of a living creature with an eye at an intermediate level. A peephole is formed in the curtain by a cut therethrough, and preferably the cut is positioned to extend around a lower portion of an eye of the decorative image and forms a deflectable flap which is movable to open and close. The peephole is positioned at an intermediate level on the curtain to permit a young child to conveniently look through the peephole. A lower end portion of the sheet material is formed with parallel vertical cuts to provide deflectable strips for permitting passage through the curtain.

6 Claims, 2 Drawing Figures

TOY DECORATIVE CURTAIN/DOOR

BACKGROUND OF THE INVENTION

1. Field of the Invention

The present invention relates to a toy decorative curtain or a flexible door which is adapted for temporary installation between the jamb surfaces of an entrance opening for use by young children and the like during play.

2. Description of the Prior Art

Roll-up window shades including a roller and a sheet of flexible material have been provided for installation on windows and doors. Decorative images of various designs have been provided on the flexible sheet material of shades and the like.

OBJECTS OF THE INVENTION

It is an object of the invention to provide and new and improved toy decorative curtain/door of the character described which is specially adapted for temporary installation between vertical jamb surfaces of an entrance opening to afford young children and the like a flexible door or curtain for use during play.

Another object of the invention is to provide a toy decorative, flexible curtain or door of the character described which has the image of a living creature provided thereon and the creature preferably has an eye, nose or mouth.

It is another object to provide a toy decorative curtain or door having a peephole formed at an intermediate level by a cut or a slit to provide a deflectable cover flap movable to open and close to permit viewing through the peephole.

Preferably the peephole is positioned to relate to the decorative image, as for example at the nose, eye or mouth thereof.

Another object of the present invention is to provide a new and improved toy decorative curtain or door which is readily adapted for temporary installation between the vertical jamb surfaces of an entrance opening to provide a closure for the opening for use during play by young children and the like.

Yet another object of the present invention is to provide a toy decorative curtain or door of the character described whereby a lower hanging portion of the curtain is formed with a plurality of slits or cuts extending upwardly from a free bottom edge and deflectable to permit young children and the like to pass through the entrance by deflecting the strips without substantially affecting the upper portion of the curtain.

Still another object of the present invention is to provide a new and improved toy decorative curtain/-door of the character described having a decorative image, preferably of a living creature in the form of an animal, monster or other type of living creature often fantasized about by young children during play.

Still another object of the present invention is to provide a new and improved toy decorative curtain/-door having support means in the form of a roller which is readily adapted to support a thin flexible curtain at a selected level in a doorway or other opening.

Another object of the present invention is to provide a new and improved toy decorative curtain/door of the character described which is relatively low in cost, interesting in appearance and usable to generate a theme for fantasy in play by young children and the like to provide long hours of enjoyment.

SUMMARY OF THE INVENTION

The foregoing and other objects and advantages of the present invention are accomplished in a new and improved toy decorative curtain/door which is adapted for temporary installation between the vertical jamb surfaces of an entrance opening such as a doorway or the like. The curtain is especially adapted for use during play by young children and the like and includes a thin sheet of flexible curtain material mounted on an elongated roller which is adapted to extend between the jambs of the entrance opening. At least one end of the roller includes means for biasing the roller in a longitudinal direction toward an opposite jamb so that the roller becomes a self-supporting hanger for the flexible curtain to provide a closure for the doorway. The flexible sheet material has an upper edge secured to the roller, a pair of opposite side edges hanging downwardly along and close to the adjacent jamb surfaces of the opening and a free bottom edge. At least one face of the curtain material is formed with a decorative image thereon, preferably of a living creature or monster. Preferably the image has a face or head with an eye, nose or mouth thereon. A peephole is formed in the curtain by a cut or slit therethrough to provide a deflectable flap movable to open and close and is located at an intermediate level on the curtain to permit a young child to look through the peephole. Preferably the peephole is positioned to relate with the eye, nose, mouth or other pertinent part of the decorative image. The curtain also includes a plurality of slits or cuts on a lower portion thereof parallel to the side edges and extending upwardly from the free bottom edge to provide a plurality of deflectable strips permitting passage through the curtains by deflection of the strips. When not in use the curtain may be rolled up on the roller and taken down from the doorway.

DESCRIPTION OF THE PREFERRED EMBODIMENT

Figure 1:
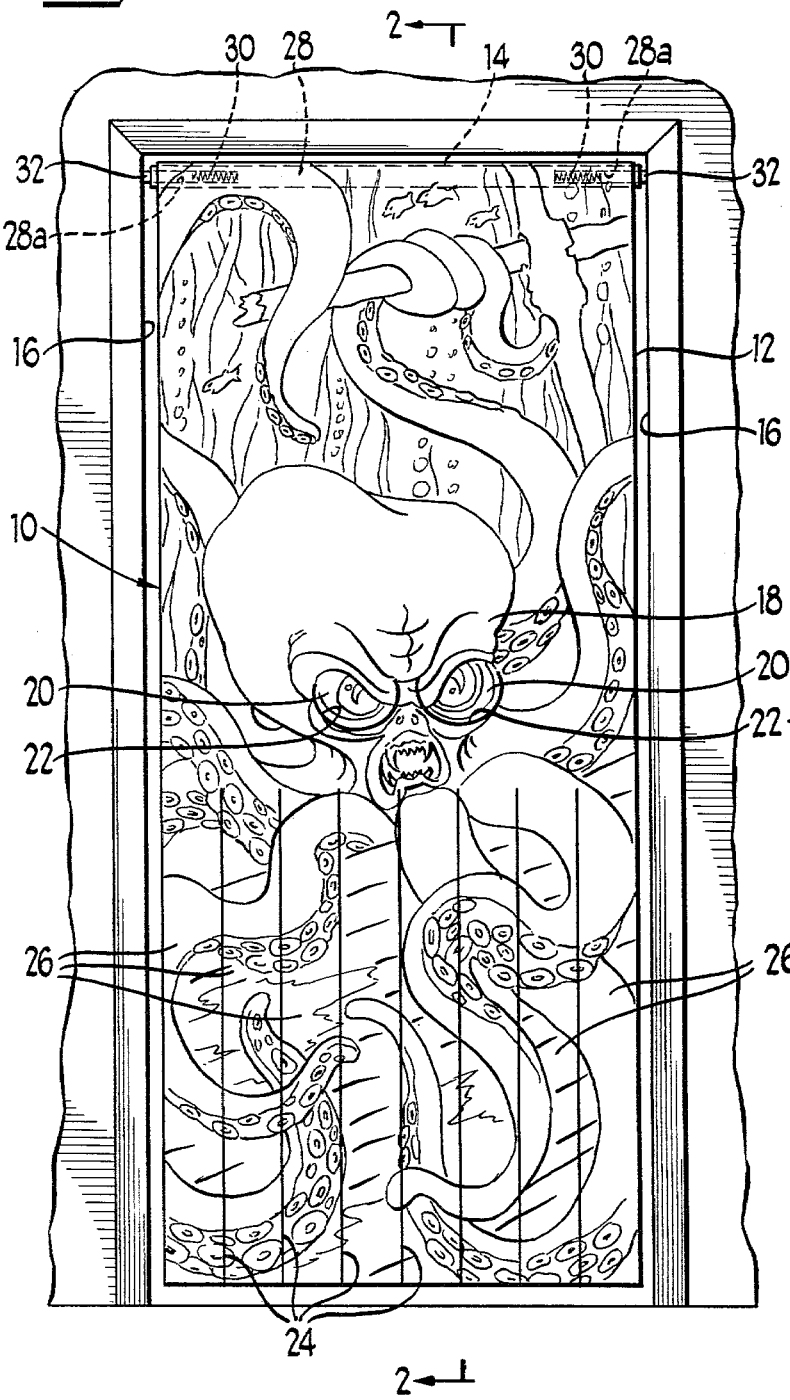
FIG. 1 is a front elevational view of a new and improved toy decorative curtain/door constructed in accordance with the features of the present invention and shown as it is installed between the jamb surfaces of an entrance opening for a door.

Referring now more particularly to the drawing, therein is illustrated a new and improved, toy decorative curtain or closure adapted for temporary installation between vertical jamb surfaces of an entrance opening or the like. The decorative curtain or door is referred to generally by the reference numeral 10 and includes a generally rectangular-shaped sheet of flexible curtain material 12 attached at an upper end to an elongated roller assembly 14 adapted to extend transversely between a pair of opposite vertical jamb surfaces 16. The jambs form opposite sides of a generally rectangular shaped entrance opening or the like which is slightly larger in size than the dimensions of the rectangular curtain or sheet material 12 when unrolled and hanging from the roller assembly.

Preferably the sheet material 12 is formed of vinyl, film or sheeting having a thickness of several mils and generally similar to vinyl sheeting material commonly used in window shades and the like. The vinyl film may be opaque or transparent and at least on one face is provided with a decorative image. Preferably the image is in the form of a living creature such as an octopus-like monster 18 having a head with a pair of eyes 20, a nose, or mouth positioned at an appropriate mid-level on the decorative curtain. Other types of living images depicting ghosts, other creatures and monsters that children often fantasize about may be provided and images may be formed on both faces of the curtain material with eyes, nose, mouth, ears, etc. thereof at a common location for both images. When images are formed on both faces, the images may be identical or different in appearance, and images or pictures of things other than living creatures may be provided.

Figure 2:
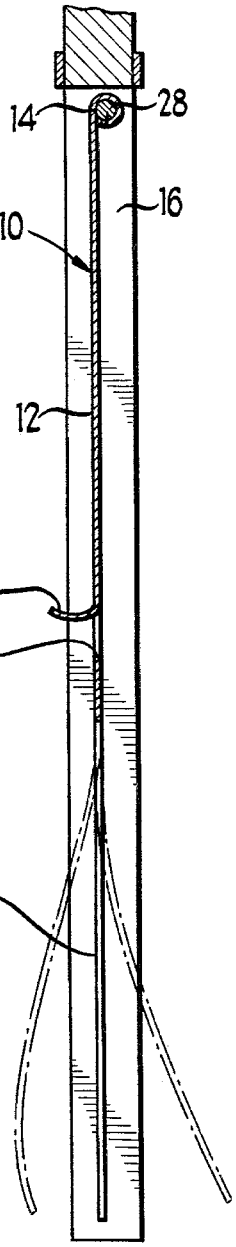
FIG. 2 is a vertical cross-sectional view taken substantially along lines 2-2 of FIG. 1.

Around a lower portion of each eye 20 of the creature 18 the curtain material 12 is cut or slit to form a flap that is deflectable outwardly as shown in FIG. 2. The cuts or slits form peephole openings 22 so that a child or person on one side of the flexible curtain 12 can view the other side and vice-versa when the eye flaps are deflected. The peepholes are provided at an intermediate level so that small children can conveniently look through the openings.

In accordance with the present invention a lower portion of the sheet material is formed with a plurality of vertically extending parallel, spaced apart slits or cuts 24 extending upwardly from a lower or free bottom edge of the sheet material and in parallel with opposite side edges of the sheet. The cuts terminate at an upper level on a common line spaced below the level of the peepholes 22. The slits 24 form a plurality of flexible strips 26 along a bottom portion of the shade material and these strips may tend to resemble the legs or arms of the octopus image. Deflection of the strips provides for ready passage through the curtain by young children and the like and this deflection is shown in animated form in FIG. 2. The deflection of the strips 26 on the lower portion of the sheet material 12 does not substantially affect the upper portion of the curtain above the upper ends of the cuts 24. When the image 18 represents an octopus-like creature or monster, the flexible strips 26 may be thought to simulate the wriggling arms or tentacles of the creature. The flexible sheet material 12 may be rolled up on the rod-like roller assembly 14 so the decorative curtain may be stored or put away when not in use. When rolled up the curtain requires a minimal amount of storage space.

The roller assembly includes a cylindrical body 28 preferably formed of inexpensive material such as wood or the like and formed with a pair of cylindrical coaxially aligned inwardly extending recesses **28*a* at opposite ends. In each recess is mounted a spring 30 and a door jamb engaging plunger 32 is attached to an outer end of the spring for engagement against the adjacent face of a jamb 16** to support the decorative curtain in place as shown at any desired level in the doorway or entrance.

The springs 30 are chosen to be of sufficient strength to exert a holding force outwardly on the respective plungers 32 so that frictional engagement between the outer end surfaces of the plungers and the jamb surfaces 16 is sufficient to support the entire decorative curtain assembly in a rolled-up or in an unrolled condition as illustrated ready for play. When not in use the decorative curtain may be rolled up on the roller assembly and left in place at an upper level in the door opening usually so as not to interfere with normal traffic through the door opening. When chilren wish to play, the decorative curtain is then unrolled to hang downwardly from the roller body 28 as shown wherein the lower free edge of the unrolled curtain spaced a short distance above the floor.

What is claimed and sought to be secured by Letters Patent of the United States is:

1. A toy decorative curtain/door adapted for temporary installation between vertical jamb surfaces of an entrance opening, comprising:

a sheet of thin flexible curtain material mounted on an elongated roller adapted to extend between said opposite jamb surfaces;

at least one end portion of said roller including means for biasing said roller in a longitudinal direction toward an opposite end for supporting said roller between said jamb surfaces at a selected elevation thereon;

said flexible sheet material having an upper edge secured to said roller longitudinally thereof, a pair of opposite side edges hanging downwardly of said roller adjacent said opposite jamb surfaces and a free bottom edge;

at least one face of said material having a decorative image thereon, said image including a graphic representation of a living creature with at least one graphic eye, said material also including a peephole formed in said curtain by a cut therethrough at a position adjacent said graphic eye to form a deflectable flap movable to open and close said peephole to permit viewing through said peephole; and the portion of said sheet material below said peephole formed with a plurality of cuts therethrough, generally parallel to said side edges and extending upwardly from said free bottom edge and terminating below said peephole to form a plurality of deflectable strips permitting passage through said entrance upon deflection of said strips, said image located at least in part on said portion formed with said cuts so that said image appears to move in a lifelike manner when said strips are deflected.

2. The toy decorative curtain/door of claim 1 wherein said strips have a narrow face width in relation to their height above said free edge of said sheet material.

3. The toy decorative curtain/door of claim 7 wherein said plurality of strips terminate along a common line at the upper ends.

4. The toy decorative curtain/door of claim 1 wherein said biasing means comprises spring means and a plunger mounted for axial movement in one end of said roller, said plunger biased outwardly of said one end for holding engagement against an adjacent jamb surface.

5. The toy decorative curtain/door of claim 1 including another of said biasing means provided on the opposite end of said roller for holding engagement against an adjacent opposite jamb surface.

6. The toy decorative curtain/door of claim 1 wherein said cut extends around a lower portion of said eye.

* * * * *